US008196257B2

(12) United States Patent
Hanschur et al.

(10) Patent No.: US 8,196,257 B2
(45) Date of Patent: Jun. 12, 2012

(54) UPRIGHT VACUUM CLEANER

(75) Inventors: Mark Hanschur, Bielefeld (DE); Udo Mersmann, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 943 days.

(21) Appl. No.: 12/199,076

(22) Filed: Aug. 27, 2008

(65) Prior Publication Data

US 2009/0056054 A1 Mar. 5, 2009

(30) Foreign Application Priority Data

Aug. 30, 2007 (DE) ..... 10 2007 040 952

(51) Int. Cl.
*A47L 5/30* (2006.01)

(52) U.S. Cl. ..... 15/332; 15/334; 15/335; 15/337; 15/339; 15/410

(58) Field of Classification Search ..... 15/331, 15/332, 334, 335, 337, 410, 339; *A47L 5/30*
See application file for complete search history.

(56) References Cited

U.S. PATENT DOCUMENTS

| | | | |
|---|---|---|---|
| 4,761,850 | A | 8/1988 | Romeo et al. |
| 5,331,715 | A | 7/1994 | Johnson et al. |
| 5,477,586 | A | 12/1995 | Jacobs et al. |
| 6,108,861 | A | 8/2000 | Vystrcil et al. |
| 6,260,233 | B1 | 7/2001 | Wareham et al. |
| 6,572,078 | B1 | 6/2003 | Thomson et al. |
| 7,650,668 | B2 | 1/2010 | Kim |
| 2003/0051307 | A1 | 3/2003 | Hashizume et al. |
| 2003/0226228 | A1 | 12/2003 | Symensma et al. |
| 2005/0210627 | A1 | 9/2005 | Luebbering et al. |
| 2006/0042043 | A1 | 3/2006 | Kim |
| 2006/0070203 | A1 | 4/2006 | Fischer |
| 2006/0070204 | A1 | 4/2006 | Blocker et al. |
| 2007/0094838 | A1 | 5/2007 | Zahuranec et al. |
| 2007/0209147 | A1 | 9/2007 | Krebs et al. |
| 2009/0056055 | A1 | 3/2009 | Andrup et al. |
| 2009/0056061 | A1 | 3/2009 | Andrup et al. |

FOREIGN PATENT DOCUMENTS

| | | | |
|---|---|---|---|
| EP | 0708613 | A1 | 5/1996 |
| GB | 373072 | A | 5/1932 |
| GB | 1394497 | A | 5/1975 |

(Continued)

OTHER PUBLICATIONS

European Search Report for EP 08 01 4880, dated Jul. 13, 2011.

(Continued)

*Primary Examiner* — David Redding
(74) *Attorney, Agent, or Firm* — Leydig, Voit & Mayer, Ltd.

(57) ABSTRACT

An upright vacuum cleaner for cleaning a surface includes a base unit with a brush motor and a brush roller drivable by the brush motor. An air conduit leads from the base unit to a dust collection container and includes an interface and a first section downstream of the interface. The first section includes a hose or a hose-and-wand assembly and is arranged externally on an upper body of the vacuum and is also securable to the upper body. A receiving structure on the upper body is configured to receive the first section and is removable from the receiving structure in a region of the interface so as to enable a vacuuming mode of operation that is independent of the base unit. A turning-off device is operable to turn off the brush motor when the first section is removed from the receiving structure.

4 Claims, 7 Drawing Sheets

FOREIGN PATENT DOCUMENTS

| | | | |
|---|---|---|---|
| GB | 2291336 | A | 1/1996 |
| GB | 2349069 | A | 10/2000 |
| GB | 2350553 | A | 12/2000 |
| NL | 7305557 | A | 10/1973 |
| WO | WO 2005/110178 | A1 | 11/2005 |
| WO | WO 2006/015309 | A2 | 2/2006 |
| WO | WO-2007008770 | | 1/2007 |

OTHER PUBLICATIONS

European Patent Office, European Search Report in European Patent Application No. 08014482 (Dec. 22, 2009).

UPRIGHT VACUUM CLEANER

CROSS REFERENCE TO RELATED APPLICATIONS

Priority is claimed to German patent application DE 10 2007 040 952.6, filed Aug. 30, 2007, which is hereby incorporated by reference herein.

FIELD

The present invention relates to a vacuum cleaner of the upright type, including an upper body containing a dust collection container, a base unit containing a brush roller which is drivable by a motor, and a carriage permitting said base unit to move on the surface to be cleaned.

BACKGROUND

The following is a description of three types of vacuum cleaners which differ in design and operation. All of them have, as common features, a motor-driven fan, a dust collection chamber, and one or more floor treatment devices which are each adapted for a particular purpose.

The canister vacuum cleaner has a housing which can be moved on the floor to be cleaned on wheels and/or runners. The housing contains the motor-fan unit and the dust collection container. The floor treatment device, here referred to as floor nozzle, is connected to the dust collection chamber via a suction hose, and possibly a suction wand connected therebetween. During vacuuming, the housing is moved to the desired position by pulling on the suction wand.

In a stick vacuum cleaner, the motor-fan unit and the dust collection container are also disposed in a housing. A suction wand extends from one end of the housing, connecting the floor nozzle to the dust collection container, and a handle used to maneuver the housing to the desired position extends from the other end.

Uprights do not have as strictly divided a configuration as the two aforementioned types. One feature of an upright is a movable base unit which carries an upper body containing a large dust collection container. The two parts may be tiltable relative to each other and can usually be locked in a parked position in which the upper body is nearly upright when the base unit is located on a horizontal floor in a position of use. In this position, the upright stands unsupported. During vacuuming, the above-described locked engagement is released, and the upper body is tilted through a certain angle to an operating position. The tilt angle depends on the height of the user and on the particular purpose of use. A handle is provided on the upper body for maneuvering the entire appliance. In order to give the user additional options for vacuuming besides vacuum cleaning with the base unit, such as above-the-floor-vacuuming, the air conduit has an interface and, downstream thereof, a section which is formed by a hose or hose/wand assembly (see, for example, WO 2007/008770 A1 or EP 0 708 613 B1). In most designs, a wand member is held in an insertion receptacle. After removing the wand member from the insertion receptacle, different types of vacuum attachments may be attached to the suction end thereof. The assembly so formed can be used in the same manner as with a conventional canister vacuum cleaner. During such operation, the upright is usually in a parked position, in which the upper body is locked in position on the base unit. In order to prevent excessive wear on the footprint area, the brush motor can be turned off in this mode of operation. In some designs, switches may be provided which detect the locked position and disconnect the brush motor from the power supply.

During standard vacuuming with the base unit, the user may happen to detect dirt at positions above the floor, such as on moldings or the like, which he/she wishes to remove using the hose or the hose/wand assembly. In such a situation, the user typically holds the upper body in a tilted position with one hand by the handle and removes the hose or hose/wand assembly from its holder with the other hand so as to perform the vacuuming operation. In such situations, the brush motor is not turned off because the upright is not in the parked position.

SUMMARY

In view of the above, an aspect of the present invention is to provide a vacuum cleaner of the upright type so as to prevent excessive wear on the footprint area of the base unit when vacuuming with the hose or hose/wand assembly while the vacuum cleaner is out of its parked position.

In an embodiment, the present invention provides an upright vacuum cleaner for cleaning a surface. The upright vacuum cleaner includes a base unit with a brush motor and a brush roller drivable by the brush motor. A carriage is configured to move the base unit on the surface. An upper body is supported on the vacuum cleaner so as to be at least tiltable relative to the base unit and lockable in a parked position such that the vacuum cleaner is in a substantially upright position when standing on the surface. The upper body includes a dust collection container. The vacuum also has a motor-fan unit configured to provide a partial vacuum to act on the surface to be cleaned. An air conduit leads from the base unit to the dust collection container and includes an interface and a first section downstream of the interface. The first section includes a hose or a hose-and-wand assembly and is disposed externally on the upper body and is also securable to the upper body. A receiving structure on the upper body is configured to receive the first section and is removable from the receiving structure in a region of the interface so as to enable a vacuuming mode of operation that is independent of the base unit. A turning-off device is operable to turn off the brush motor when the first section is removed from the receiving structure.

BRIEF DESCRIPTION OF THE DRAWINGS

An exemplary embodiment of the present invention is described in more detail below and shown in a schematic way in the drawings, in which.

DETAILED DESCRIPTION

The present invention relates to a vacuum cleaner of the upright type, in an embodiment including an upper body containing a dust collection container, a base unit containing a brush roller which is drivable by a motor, and a carriage permitting the base unit to move on the surface to be cleaned. The upper body is supported such that it is at least tiltable relative to the base unit and capable of being locked in a parked position in which the vacuum cleaner assumes a substantially upright position when standing on the surface to be cleaned. The vacuum cleaner may further include a motor-fan unit for creating a partial vacuum to act on the surface to be cleaned, and an air conduit leading from the base unit to the dust collection container. The air conduit can have an interface and include a section which is formed by a hose or hose/wand assembly and is located downstream of the interface. This section is arranged externally on the upper body in such a manner that it is securable thereto and that, when disconnected in the region of the interface, it enables a vacuuming mode of operation which is independent of the base unit and in which the drive motor of the brush roller can be turned off.

The present invention allows the floor covering under the base unit to be protected, to the extent possible, from damage even in situations where the upright is not in its parked position. In addition, the brush motor is protected from overheating, and energy is saved.

The switch assembly can include an actuating cam disposed on the hose or on the hose/wand assembly, and a switch provided in the upper body. The actuating cam may be in the form of a hook provided on a wand handle, and the switch may be disposed behind an aperture in a receiving structure for the wand handle. Thus, in addition to the disconnection feature, a guide is provided to aid in the insertion of the wand handle, and the handle is reliably retained in the receiving structure provided for this purpose.

The upright vacuum cleaner shown in different views in FIGS. 1 through 6 (hereinafter abbreviated as upright 1) includes a base unit 2, an upper body 3, and a joint disposed therebetween, which will be described in greater detail further on in this specification.

Figure 5:
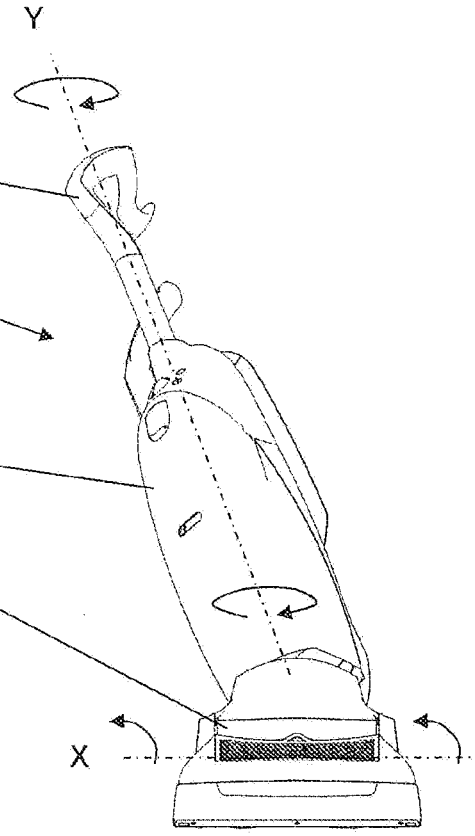
Figure 6:
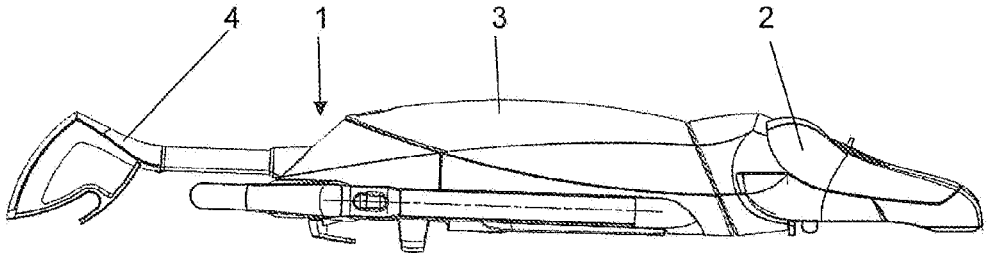

Upright 1 can be brought from an upright position (see FIGS. 1 through 3), in which it can be locked and stand unsupported, to a tilted position (FIGS. 4 and 5), or even to a fully flat position (FIG. 6), after the locked engagement has been released. To this end, base unit 2 and upper body 3 are connected in such a manner that they can be tilted relative to each other about an axis X extending horizontally in a position of use (see FIG. 5). This pivoting movement is made possible by a joint which is hereinafter referred to as "tilting joint". In the tilted position, the upright can be rotated about an axis Y, as is also shown in FIG. 5. The user can maneuver base unit 2 through curves by rotating upper body 3 about the aforesaid axis using handle 4 while simultaneously pulling or pushing the upright. The corresponding joint is hereinafter referred to as "swivel joint".

Figure 7:
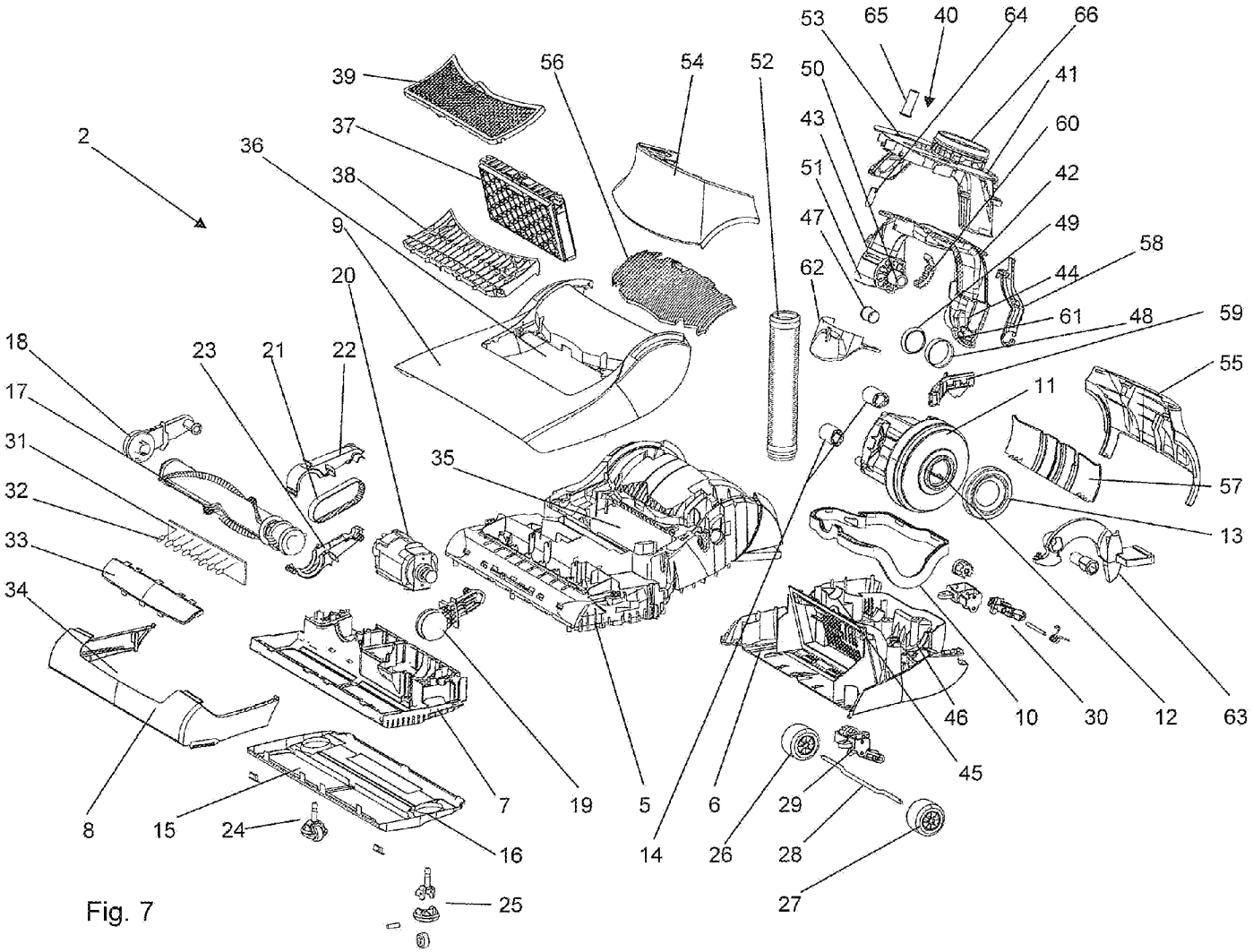
FIG. 7 is an exploded view showing the base unit of the vacuum cleaner.

Base unit 2, shown in the exploded view of FIG. 7, has a housing including a housing insert 5, a lower rear housing part 6, a lower front housing part 7, a bumper strip 8, and a cover part 9. Housing insert 5 functions as a support for a number of electrical and mechanical components. The aforementioned housing parts are also attached thereto. The housing insert, lower rear housing part 6, and a motor chamber seal 10 placed therebetween, together form a chamber for receiving a motor-fan unit 11 for creating the partial vacuum required for vacuuming. A sealing ring 13 is provided around fan inlet 12 on the suction side, said sealing ring also bearing against the two aforementioned housing parts 5 and 6. Rubber buffers 14 are inserted on the opposite side. For deep cleaning of carpets, a brush roller 17 extends into suction mouth 15, which is an opening in lower front housing part 7 and bottom plate 16, which is attached thereto, said brush roller being resiliently mounted on two lateral pivoting arms 18 and 19 and being driven by a brush motor 20 via a belt 21. A two-part belt cover is provided by parts 22 and 23. Brush motor 20 is also attached to housing insert 5, and pivoting arms 18 and 19 are pivotably secured thereto. The carriage of the upright is formed by front casters 24 and 25 and rear wheels 26 and 27 and is supported by the two lower housing parts 6 and 7. Rear wheels 26 and 27 are connected by an axle 28 for purposes of stability, and are adjustable in position by means of a wheel mechanism 29 and 30, respectively. A circuit board 31 carrying LEDs 32 is secured to housing insert 5 to illuminate the travel path and is covered at the front by a transparent plate 33. Transparent plate 33 is held in a cut-out 34 in bumper strip 8.

The air generated by the motor-fan unit 11 is discharged into the environment through an opening 35 in housing insert 5 and a corresponding opening 36 in cover part 9. A filter frame 37 is inserted into opening 36 to hold an exhaust filter for removing ultrafine particles from the exhaust air. Filter frame 37 is covered by a grating holder 38 and a grating 39 within cover part 9, from where it can be replaced.

Both the tilting joint and the swivel joint between base unit 2 and upper body 3, which will be described in greater detail hereinafter, are provided by a rigid, yoke-shaped duct member. This member also contains portions of the air passageway from suction mouth 15 to upper body 3, and the air passageway from upper body 3 to the exhaust port (openings 35 and 36). This member is hereinafter referred to as yoke 40. It is formed by two plastic parts, an upper shell 41 and a lower shell 42, which are welded together. In order to create the tilting joint, the two ends 43 (right) and 44 (left) of yoke 40 are pivotably mounted in openings 45 and 46 provided for this purpose, and are surrounded by metal bearing sleeves 47 and 48, respectively, in order to avoid wear. Yoke end 44, which is on the left side as viewed in the direction of travel, is hollow and is coupled to fan inlet 12 via a seal 49. A trunnion 50 is integrally formed with yoke end 43, which is on the right side as viewed in the direction of travel. Moreover, the right yoke end has an opening 51 which is connected by a flexible tube 52 to suction mouth 15. In order to prevent the interior of base unit 2 from becoming visible when tilting the upper body 3, the connecting portion between the two yoke ends 43 and 44 (hereinafter referred to as bridge portion 53) is enclosed by a front cover 54 and a rear cover 55, which are provided on base unit 2 and are capable of following the swivel motion of yoke 40. The gap between the front and rear covers and housing insert 5 is bridged by covering members 56 and 57. The first 58 of two cable ducts 58 and 59 is attached to left yoke end 44. Furthermore, yoke ends 43 and 44 carry toothed segments 60 and 61, which cooperate with wheel mechanisms 29 and 30. A covering cap 62 for a connecting cable (not shown) is secured to bridge portion 53. To enable the upright to be locked in the upright position (FIGS. 1 through 3), a foot pedal 63 is mounted on housing insert 5 which, in this position, engages with left yoke end 44, thereby preventing yoke 40 from swiveling. The locked position can be released by depressing pedal 63. Moreover, in the locked position, swivel motion is prevented by two spring-mounted pins 64 and 65. In the region of bridge portion 53, the air passages provided by yoke ends 43 and 44 are combined into a first section 66 of a coaxial conduit.

Figure 8:
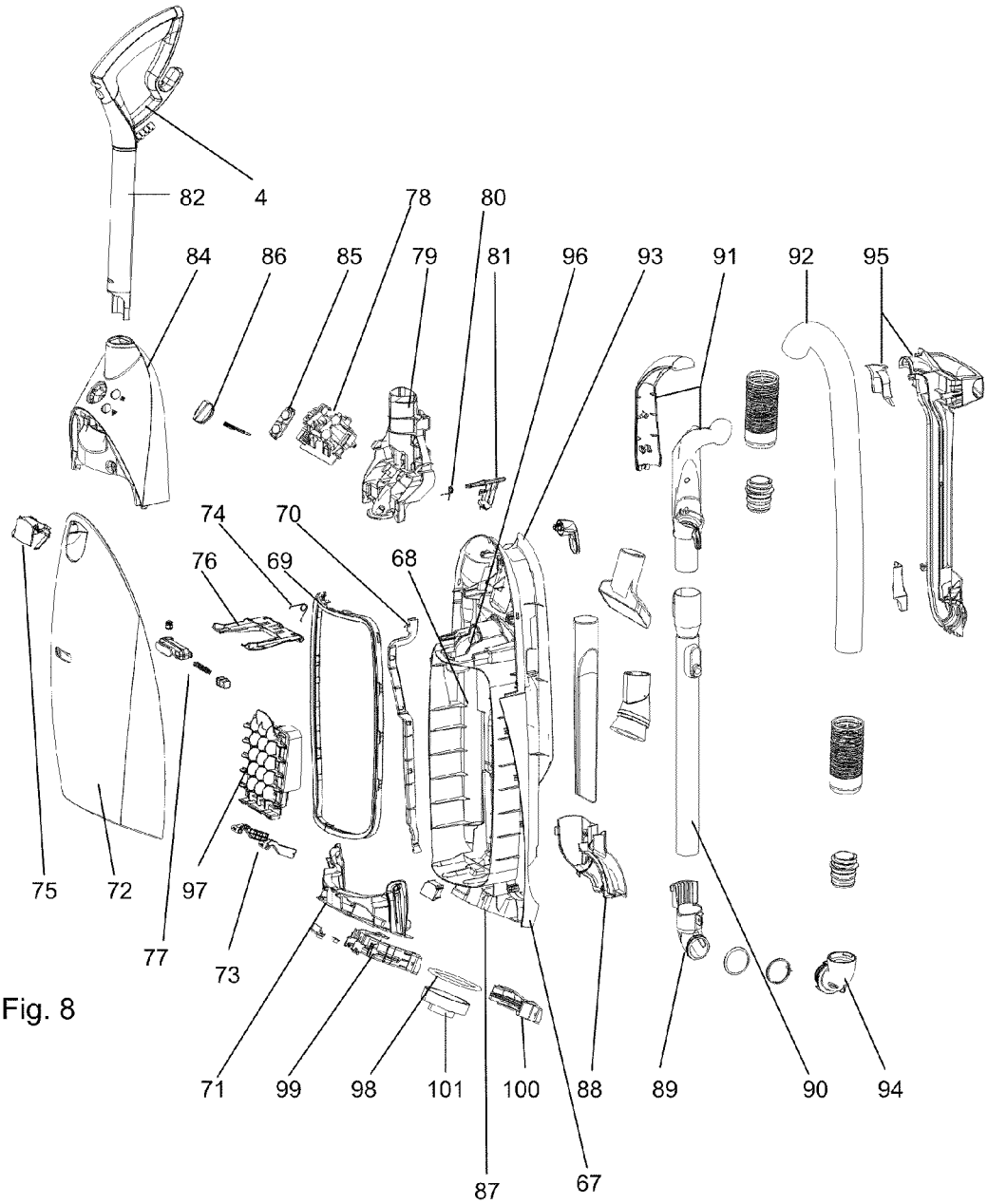
FIG. 8 is an exploded view illustrating the upper body of the vacuum cleaner.

FIG. 8 shows upper body 3, also in an exploded view. The load-bearing part of upper body 3 is a rear wall 67. The aforesaid rear wall forms the rear portion of a dust chamber 68, which in turn receives a dust collection container in the form of a filter bag (not shown in the drawing). A seal 69 surrounds the edge of dust chamber 68, and a covering strip 70 for cables (not shown) is attached at the side. A hinge bearing 71 is secured to rear wall 67 in the lower portion thereof. Dust chamber 68 is closed at the front by an upper housing part 72 which is pivoted to hinge bearing 71 by hinges 73 and torsion springs 74. Upper housing part 72 carries a locking device 75, a dust bag holder 76, and a filter replacement indicator 77 and, in addition, serves to cover hinge bearing 71. In the upper portion, rear wall 67 carries the electronics 78 of the upright, which are completely arranged on a holder 79 and can be installed as a pre-tested subassembly. A lever 81 for turning off brush motor 20 is mounted to the holder via a torsion spring 80. In addition, said holder is used to hold handle tube 82 and appliance handle 4. Electronics 78 are covered by a cap 84, which also serves for attachment of various controls and indicators and accessories thereof (transparent cover 85, rotary knob 86).

Figure 10:
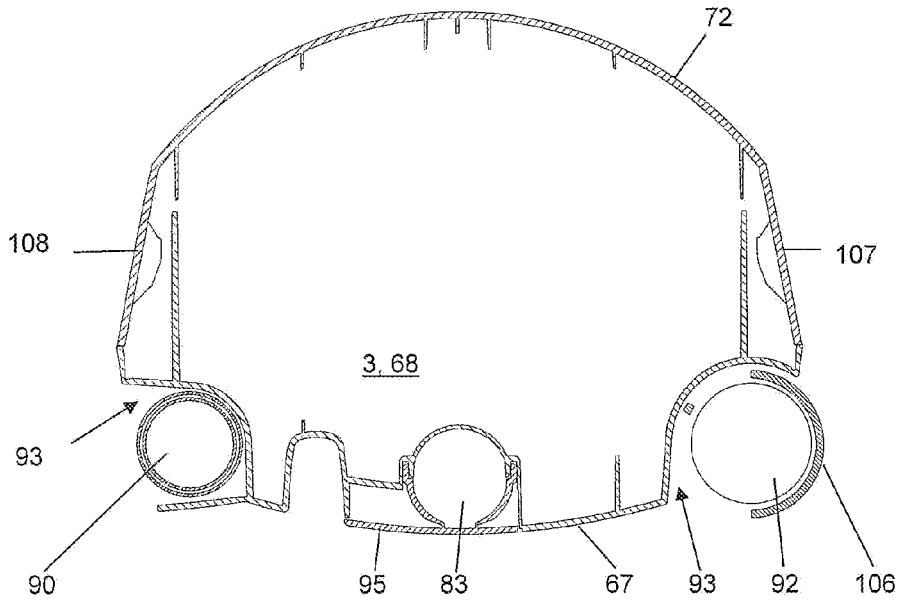
FIG. 10 is a cross-section through the upper body in the transition region from the hose to the upper body.
Figure 11A:
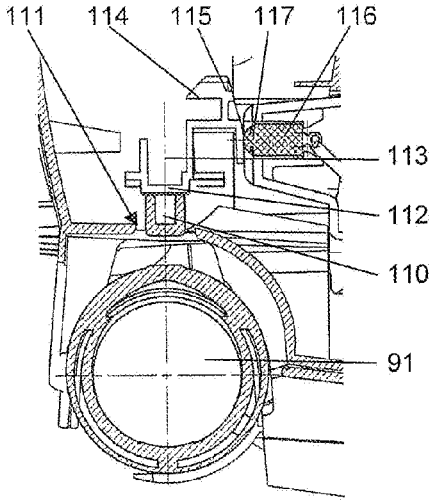
FIGS. 11*a* through 11*d* show an enlarged portion of the upper body in the region of the wand handle receiving structure with the hook inserted and removed in cross-sectional and longitudinal sectional views, respectively.
Figure 11B:
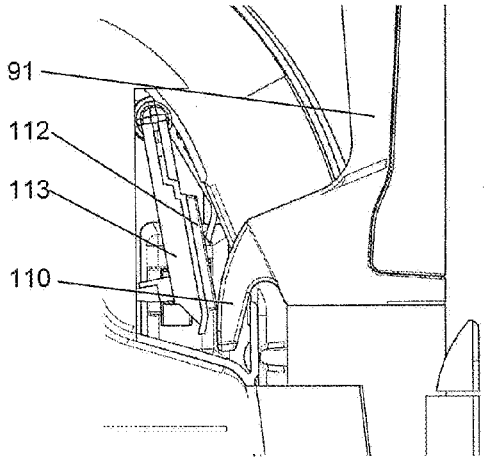
Figure 11C:
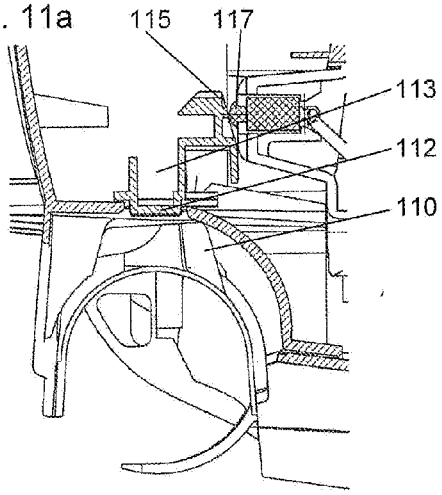
Figure 11D:
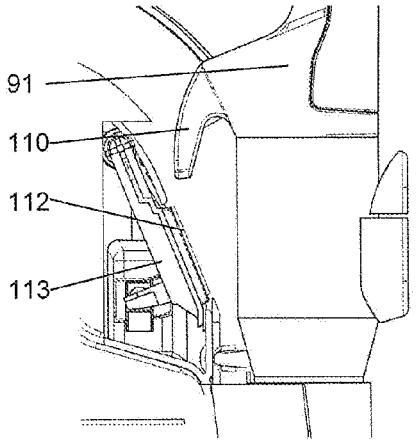

An air path system allows dirt-laden air to be optionally sucked in either through the suction mouth in the base unit or through a telescoping wand to which may be attached vacuum attachments such as a crevice tool, a dusting brush, an upholstery tool, etc. To this end, the suction air is directed from suction mouth 15 through flexible tube 52 and right yoke end 43, and further through the inner tube of first section 66 of the coaxial conduit in bridge portion 53 into the inner tube of a second section 87 of the coaxial conduit. This section 87 is continued in rear wall 67, where it is divided into two separate conduits. The air path continues through a suction duct member 88 into an elbow 89. A telescoping wand 90 is loosely, and therefore removably, inserted into elbow 89. The aforesaid telescoping wand merges into a wand handle 91 and further into a flexible suction hose 92. Suction hose 92 is held in a receiving structure 93 provided for this purpose, as can be seen also in FIG. 3. The air passes through a swivel elbow 94 into a duct 83 (see FIG. 10) which extends along the entire length of rear wall 67. Duct 83 is defined by rear wall 67 itself and an air duct member 95 placed thereon. A downstream, elbow-shaped duct member 96, which is formed by rear wall 67 and a portion of electronics holder 79, directs the dirt-laden suction air into the region of dust bag holder 76, and there into a dust bag. Once the suction air has passed through the dust bag in the dust chamber and been cleaned of dust therein, it passes through a motor protection filter (the figure shows only the frame 97 for holding the filter) and into the outer annulus of second section 87 of the coaxial conduit, and from there through first section 66 and left yoke end 44 to motor-fan unit 11.

The lower portion of FIG. 8 further shows the components used for attaching and rotatably supporting upper body 3 on yoke 40. First section 66 of the coaxial conduit is surrounded by a metal ring 98 which is enclosed by injection-molded material and projects beyond the outside diameter of said section 66, and which is held around its circumference in two bearing shells 99 and 100. Bearing shells 99 and 100 are connected to upper body 3. Accordingly, metal ring 98 and bearing shells 99 and 100 together form the swivel joint of upright 1. When joining upper body 3 and yoke 40, the two sections 66 and 87 of the coaxial conduit are joined together with a seal 101 interposed therebetween.

Figure 9:
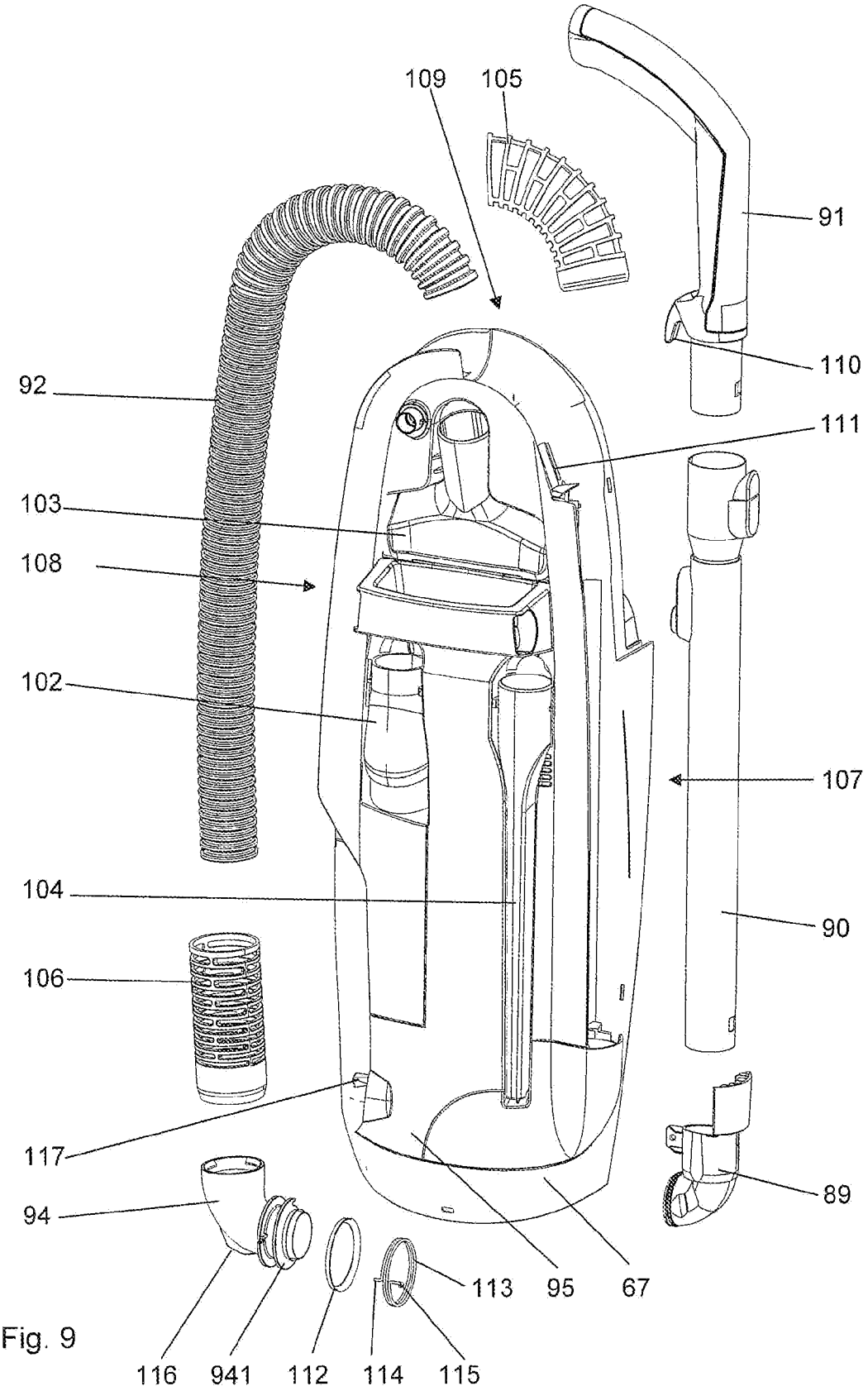
FIG. 9 is a rear view showing the upper body and portions of the air conduit in an exploded view.

The air path portion that enables vacuuming independently of base unit 2 is shown in an exploded view in FIG. 9. Elbow 89 provides the interface at which this portion can be separated. Telescoping wand 90 is inserted in elbow 89 and can be removed therefrom. Telescoping wand 90 is, in turn, detachably secured to wand handle 91. Various vacuum attachments, including a dusting brush 102, an upholstery tool 103 and a crevice tool 104, are secured on the outside of rear wall 67 of the upper body, and may optionally be attached to either telescoping wand 90 or wand handle 91. Wand handle 91 is connected to flexible suction hose 92, the transition region from handle 91 to hose 92 being surrounded by an upper anti-kink sleeve 105. Flexible hose 92 is then connected to swivel elbow 94, this second transition region from hose 92 to swivel elbow 94 being surrounded by a lower anti-kink sleeve 106.

Figure 3:
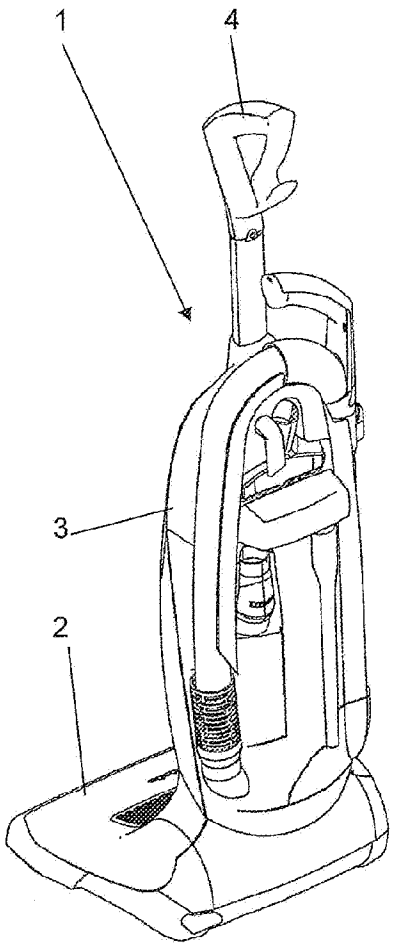
FIGS. 1 through 6 show various overall views of the vacuum cleaner of the present invention.
Figure 2:
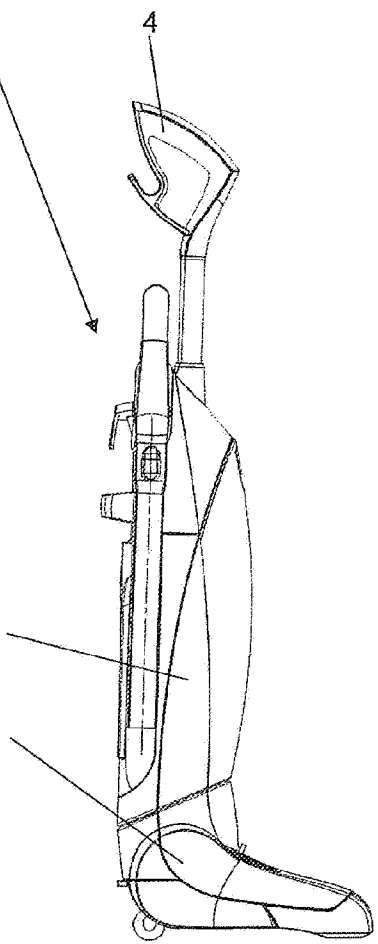
Figure 1:
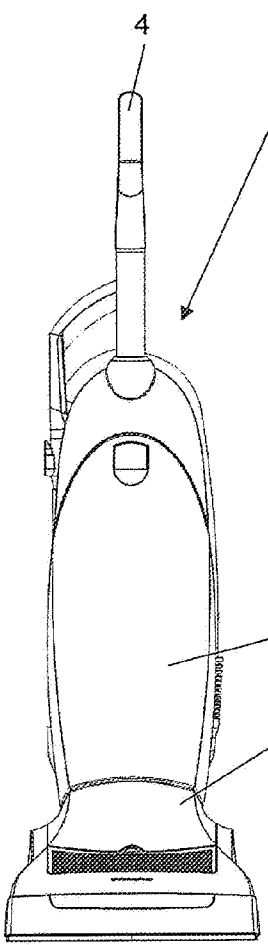
Figure 4:
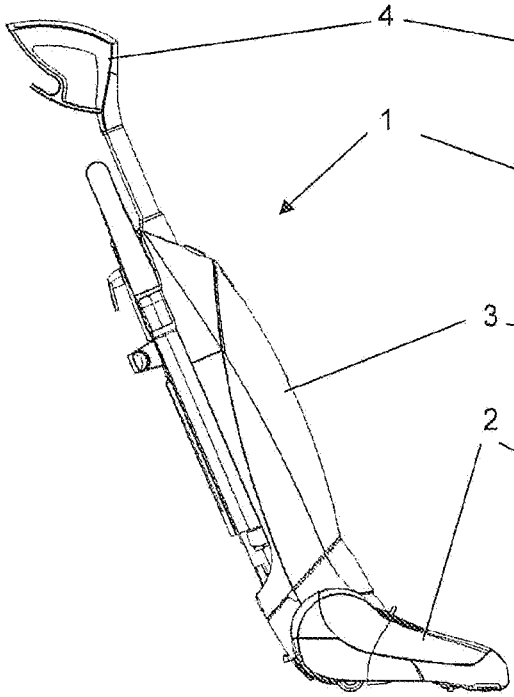

It can be seen from FIGS. 3 and 9 that receiving structure 93, which holds telescoping wand 90, wand handle 91 and hose 92, is U-shaped and extends along nearly the entire length of the two side surfaces 107 and 108 and upper surface 109 of upper body 3. At side surface 108, which is on the left side as viewed in the direction of travel and shown to the left in FIG. 9, only the second transition region, which is formed by swivel elbow 94 and lower anti-kink sleeve 106, is left free. It can be seen both in FIGS. 3 and 9 and in the cross-sectional view of FIG. 10 that receiving structure 93 is recessed into side surfaces 107 and 108 and into upper surface 109. The cross-sectional view of FIG. 10 further illustrates that in the second transition region on left side 108, receiving structure 93 has a cross-section of only a quadrant of a circle. Since receiving structure 93 is arranged in side surfaces 107 and 108 and in upper surface 109 of upright 1, the open side of the receiving structure 93 faces upward and to the left and right sides of upright 1 when it is in the parked position (FIGS. 1 through 3). After completion of a vacuuming operation in a mode that is independent of base unit 2, the user can simply insert telescoping wand 90 into elbow 89. An additional positioning aid is provided by a hook 110 on wand handle 91, which is inserted into an aperture 111 in receiving structure 93. Telescoping wand 90 and wand handle 91 are then received by receiving structure 93 in right side wall 107. In this process, flexible hose 92 lays itself into the portion of receiving structure 93 that faces toward upper surface 109. The remainder of the hose 92 can then be stored in receiving structure 93 at left side wall 108 with a slight pressure from the side. The upper anti-kink sleeve 105 behind wand handle 91 is made from a relatively soft plastic material, such as TPE or PVC, having a hardness between 60 and 70 Shore A, and can therefore be easily pressed into receiving structure 93.

FIGS. 11*a* through 11*d* and FIG. 12 show that hook 110 has another function in addition to serving as a guide for positioning wand handle 91. Aperture 111, which is shown in FIGS. 11*a* through 11*d* in enlarged views of a portion of the upright in the region of receiving structure 93, is covered by the pressure plate 112 of a rotatably mounted rocker switch 113. Rocker switch 113 has an integrally formed lateral projection 114 having a sloped actuation surface 115 and a spring at its pivot point, said spring not being shown in the drawings. The upper body has disposed therein a switch 116 whose contacts are closed by a mushroom-headed push button 117, which is located within the reach of projection 114.

Figure 12:
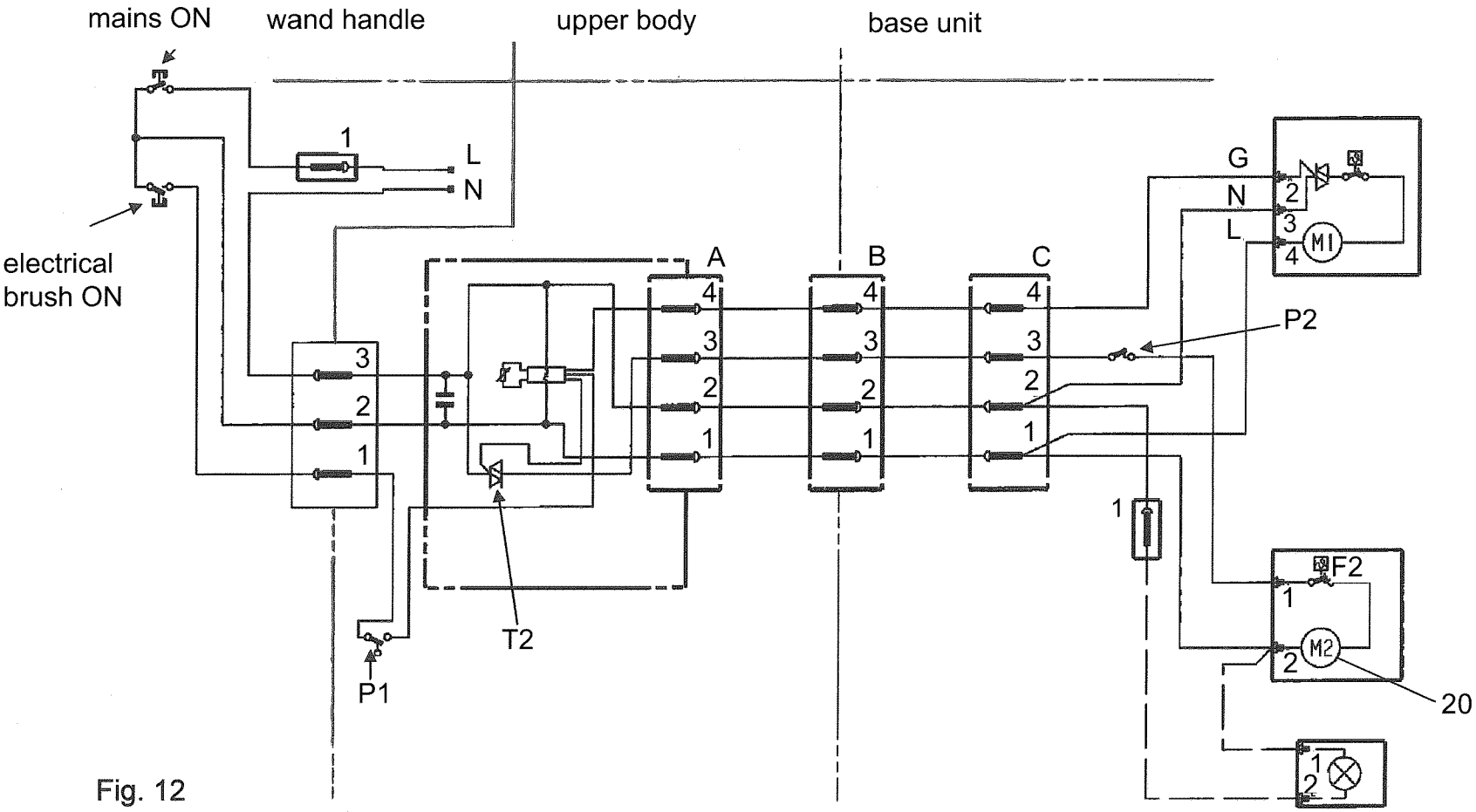
FIG. 12 is an electrical circuit diagram of the upright.

FIG. 12 shows an electrical circuit diagram of the upright. The following describes only how brush motor 20 (referred to as M2 in the figure) is energized, and the involved switching operations. After activating the "mains ON" switch and the "electrical brush ON" switch on the handle, the two additional switches P1 and P2 are connected in series to the mains voltage and, when the contacts are closed, said additional switches pass the mains voltage to brush motor 20, i.e. M2. Brush motor 20, i.e. M2, is controlled by triac T2. P1 represents the above-described switch behind the aperture in the wand handle receiving structure. P2 denotes the above-mentioned switch which detects when the upper body is locked in the parked position and which, in such position, opens the contacts. The starting point for the following description is the assumption that the switches "mains ON", "electrical brush ON", and P2 are closed.

When inserting the hook into the aperture (FIGS. 11*a* and *b*), the hook exerts a pressure on the actuation plate, thus turning the rocker switch in a clockwise direction. In this process, the sloped actuation surface 115 of projection 114 moves onto the mushroom-headed push button 117 of switch 116, i.e., P1, thereby closing the contacts of switch 116, i.e., P1. Brush motor 20, i.e., M2, is energized and rotates brush roller 17. When the user then removes wand handle 91 from receiving structure 93, he/she thereby pulls hook 110 out of aperture 111. The spring exerts a force on rocker switch 113, such that said rocker switch is rotated counterclockwise to the position in which pressure plate 112 covers aperture 111 (see FIGS. 11*c* and *d*). Projection 114 is removed from engagement with mushroom-headed push button 117, thereby opening the contacts of P1 and turning off brush motor M2.

The present invention has been described herein based on one or more exemplary embodiments, but is not limited thereto. Reference should be had to the appended claims.

What is claimed is:

1. An upright vacuum cleaner for cleaning a surface, the upright vacuum cleaner comprising:

a base unit including a brush motor and a brush roller drivable by the brush motor;

a carriage configured to move the base unit on the surface;

an upper body including a dust collection container, the upper body being supported so as to be at least tiltable relative to the base unit and lockable in a parked position such that the vacuum cleaner is in a substantially upright position when standing on the surface;

a motor-fan unit configured to provide a partial vacuum to act on the surface;

an air conduit leading from the base unit to the dust collection container, the air conduit including an interface and a first section downstream of the interface, the first section including a hose or a hose-and-wand assembly and including a wand handle, the first section being disposed externally on the upper body and securable to the upper body;

a receiving structure on the upper body configured to receive the first section, the first section being removable from the receiving structure in a region of the interface so as to enable a vacuuming mode of operation that is independent of the base unit; and a turning-off device operable to turn off the brush motor when the first section is removed from the receiving structure, the turning-off device including an actuating cam disposed on the first section and a switch disposed on the upper body, the actuating cam including a hook disposed on the wand handle.

2. The vacuum cleaner as recited in claim 1 wherein the receiving structure is configured to receive the wand handle and wherein the switch is disposed behind an aperture in the receiving structure.

3. The vacuum cleaner as recited in claim 1 wherein the motor-fan unit includes a motor.

4. The vacuum cleaner as recited in claim 1 wherein the motor-fan unit includes a fan.

* * * * *